US006917277B2

(12) United States Patent
Ohashi et al.

(10) Patent No.: US 6,917,277 B2
(45) Date of Patent: Jul. 12, 2005

(54) FUSE AND FUSE PRODUCTION METHOD

(75) Inventors: Hitoshi Ohashi, Susono (JP); Tatsuya Kato, Susono (JP); Hitoshi Ushijima, Susono (JP); Hiroyo Ayuzawa, Susono (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/368,394

(22) Filed: Feb. 20, 2003

(65) Prior Publication Data

US 2003/0156005 A1 Aug. 21, 2003

(30) Foreign Application Priority Data

Feb. 21, 2002 (JP) ..... P2002-045176
Mar. 4, 2002 (JP) ..... P2002-057694

(51) Int. Cl.[7] ..... H01H 85/06; H01H 85/11

(52) U.S. Cl. ..... 337/160; 337/296; 337/290; 29/623

(58) Field of Search ..... 337/152, 160, 337/198, 296, 290, 295; 29/623

(56) References Cited

U.S. PATENT DOCUMENTS 3,425,019 A * 1/1969 Kozacka ..... 337/163
4,219,795 A * 8/1980 Panaro et al. ..... 337/296
4,227,168 A * 10/1980 Knapp, Jr. ..... 337/161
4,245,208 A * 1/1981 Belcher ..... 337/231
4,308,514 A * 12/1981 Kozacka ..... 337/159
5,373,278 A 12/1994 Saulgeot et al.
6,570,482 B2 * 5/2003 Brown et al. ..... 337/160

OTHER PUBLICATIONS

Academic Press Dictionary of Science and technology, Edited by Christopher Morris, Academic Press, INC., 1992, p. 451.*

* cited by examiner

*Primary Examiner*—Anatoly Vortman
(74) *Attorney, Agent, or Firm*—Sughrue Mion, PLLC

(57) ABSTRACT

The invention is to offer a fuse and a fuse production method excellent in reducing manufacturing cost. A fuse having an electrically conductive fuse element. The fuse element has a pair of terminal connection portions and a fusible member for electrically connecting the terminal connection portions to each other and for being fused and broken when an overload electric current flows. At least a part of the fusible portion is formed by spouting or dropping the melting metal drops.

20 Claims, 15 Drawing Sheets

FUSE AND FUSE PRODUCTION METHOD

The present application is based on Japanese Patent Applications Nos. 2002-45176 and 2002-57694, the entire contents of which are incorporated herein by reference.

BACKGROUND OF THE INVENTION

1. Field of the Invention

This invention relates to a fuse furnished with a fuse element having a pair of terminal connection portions and a fusible member, and a method of producing the same.

The fuse of the invention is used especially for protecting electric circuits of automobiles.

2. Related Art

Explanation will be made to a conventional fuse by one example of a fusible link of a cartridge type. The fusible link 201 shown in FIGS. 14A and 14B is composed of a synthetic resin-made case 202 and a metal-made fuse element 203 carried within the case 202. The fuse element 203 has a pair of terminal connection portions 204, 204 and a fusible member 205 for electrically connecting the terminal connection portions 204, 204 each other, and at a central part of the fusible member 205, a fusion-breaking portion 206 is formed for being fused and broken when an overload electrical current flows.

FIGS. 15A through 15C are developing views of the fuse element 203. The fuse element 203 is formed by punching a thin metal sheet having electric conductivity in a shape as the developed fuse element 207 (207*a*, 207*b*, 207*c*) shown in FIGS. 15A through 15C, and then subjecting to a bending step. The fusion-breaking portion 206 is shaped to have different widths W for forming necessary cross sectional areas. For example, FIG. 15A shows an example that fusion-breaking electric current is 30 A (ampere), FIG. 15B shows another example of 40 A, and FIG. 15C is 50 A. The widths W of the fusion-breaking portion 206 is determined to be W1<W2<W3.

Incidentally, in the above mentioned related art, for determining the fusion-breaking electric current, the width W of the fusion-breaking portion 206 was necessary to change, and sorts of the developed fuse elements 207 were present by the number of determining the fusion-breaking electric current. Therefore, metal molds were required in response to the sorts of the developed fuse elements 207, and production costs were influenced thereby.

If plural kinds of developed fuse elements 207 are taken out in the same metal mold, problems occur that it is difficult to enlarge the metal mold or adjust production of single kind of developed fuse elements.

On the other hands, as fuses for protecting electric circuits passing transient current of conductive rate being up to around 200% such as motor load circuits of automobiles, fusible links (F/L) have conventionally been used. The fusible link is demanded to usefully function to protect circuits when occurs burst current of conductive rate being more than 200% at time of such as dead short. That is, where the conductive current is twice of a rated value (conductive rate is 200%), such current is determined to be a boundary value, and in case, a larger current area than it is classified to be a dead short area and a lower area that it is classified to be a rare short, demanded are such fuses having characteristics useful respectively in the dead short area and the rare short area.

To state in more detail, when passing the large transient current as the dead short time, a circuit is necessarily cut off prior to breakage of a load circuit, fusion-breaking of a lead wire connected to the load circuit, or fuming occurrence. Further, for example, when opening or closing a power window of the vehicle door, a motor lock current in a middle current area of the conductive rate being less than 200% flows during about 10 seconds, and even if the motor lock current frequently flows, the circuit must not be cut off.

FIG. 16 shows a fuse element of a fuse having a delay-breaking characteristic disclosed in JP-A-5-166453. The fuse element 211 is composed of a pair of opposite terminal connection portions 212 and a fusible member 215 furnished at an intermediate part of the pair of terminal connection portions 212 and securing metal chips 213 with wrapping parts 214. The metal chip is a wire material formed by forcing out a low melting point metal and cutting it out, while the fusible member 215 is formed of a plate-like fusible metal conductor.

As to the quality of the fusible member 215, a basic material thereof is the same Cu alloy as a conductive wire, and a cross sectional area is reduced in size for instantaneously breaking when a large current flows. On the other hand, the quality of the metal chip 213 is Sn having a lower melting point than that of Cu, so that it is fused by a temperature heightening owing to electric conduction, and is dispersed within the fusible member 215 to form an alloy phase. Accordingly, at the middle or small current areas, the metal chip 213 is fused and broken by the alloy phase of higher resistance than the basic Cu alloy.

In regard to the fuse element 211 of the existing fuse, at a step of setting up the metal chips 213 on the fusible member 215, since the metal chips 213 have to be cut out at a predetermined length and a caulking is required, there is a problem that a dimensional management of the metal chips 213 is not easy. Besides, dimensions of the metal chips 213 are varied by number of setting the fusing electric current, and so another problem is that a plurality of caulking molds are required.

FIG. 17 shows a fuse element of a fuse disclosed in JP-A-8-17328. The fuse element 216 was invented for solving the above problems, and the fusible member 217 of the fuse element 216 is secured with the metal chip 219 made of a low melting point metal having a hollow portion 218 by the wrapping part 220. The metal chip 219 is formed fixedly at an outside, and if changing a diameter of a piercing hole as the hollow portion 218, a fusion-breaking characteristic of the fusible member 217 is able to be adjusted.

However, although the dimensional management has been easier than that of the metal chip 215 (see FIG. 16), there still remains a problem that the dimensional management is not yet sufficiently easy when producing. That the dimensional management is not sufficient, has a problem that the fusion-breaking time is brought about with dispersion.

The above mentioned two existing examples require the caulking for fixing metal chips, so that there is probability of creating inconvenience as deformation by the caulking step, inevitably causing cost-up thereby.

SUMMARY OF THE INVENTION

The invention has been realized in view of the above mentioned circumstances, and accordingly it is an object of the invention to offer a fuse and a fuse production method which are excellent in lowering costs.

Especially, the invention is directed to offer a fuse and a fuse production method enabling to stabilize the fusion-breaking time, cost down and prevent inconvenience as deformation.

A fuse of the invention for solving the above mentioned problems is characterized in that the fuse is furnished with a fuse element having a pair of terminal connection portions to be connected to an electric circuit and a fusible member for electrically connecting the pair of terminal connection portions each other and for being fused and broken when an overload electrical current flows, wherein at least a part of the fusible member is provided with a cluster of melting metal drops which are dropped or spouted.

In A method of producing a fuse, wherein the fuse comprises a pair of terminal contact portions which is to be connected to a electric circuit and a fusible member through which the pair of terminal contact portions are connected to each other and which is fused and broken when a over current flows therein, the method of the invention is characterized by comprising the step of:

forming at least one part of the fusible member by spouting or dropping melting metal drops.

According to the invention, the various kinds of fusible member having desired fusion-breaking characteristics can be obtained, while being excellent in cost.

The other detailed features of the invention are described as below.

(A1) In the fuse of the invention, the fusible member is spouted or dropped thereon with melting metal drops of low melting point metal having a lower melting point than that of the fusible member so as to have lumps of low melting point metal for adjusting a fusion-breaking characteristic of the fusible member.

(A2) In the fuse of the invention, the fusible member has the lumps of low melting point metal on the plane part of the fusible member.

(A3) In the fuse of the invention, the lumps of low melting point metal are supported in a receptacle provided on the fusible member.

(A4) In the method of producing a fuse of the invention, wherein lumps of low melting point metal are formed on the main body of the fusible member for adjusting a fusion-breaking characteristic of the fusible member by spouting or dropping melting metal drops of low melting point metal having a lower melting point than that of the fusible member.

(A5) In the method of producing a fuse, the fusible member has the lumps of low melting point metal on a plane part thereof.

(A6) In the method of producing a fuse, the lumps of low melting point metal are supported in a receptacle formed in the fusible member.

According to (A1), since the lumps of low melting point metal are provided on the fusible member by spouting or dropping the melting metal drops, fixing by caulking is no longer necessary. As a result, the cost-down is accomplished and no inconveniences as deformation occur. Further, the lumps of low melting point metal can be easily managed as to mass only by controlling the amount of spouting or dropping the melting metal drops, so that the fusion-breaking time is consequently settled (resulting in improvement of the quality of the fuse). In the large electric current area, since the lumps of low melting point metal are served as temperature absorbing substances, the lumps being provided by spouting or dropping the melting metal drops of metal having a lower melting point than that of the fusible member, in case the mass of the lumps of low melting point metal is reduced by controlling the amount of spouting or dropping the melting metal drops spout, the fusion-breaking time is shortened (quick blowing characteristic). In addition, if reducing the mass of the lumps of low melting point metal in the middle or small current areas, the formation of the sufficient alloy phase is delayed by dispersing the lumps of low melting point metal being the low melting point metal into the fuse element being the high melting point metal, so that the fusion-breaking time of the fusible member is elongated (slow blow characteristic).

According to (A2), the second phase of the invention, because of providing the lumps of low melting point metal, any especial process is not required to the fusible member. As a result, the cost-down is accomplished and the shape of the fusible member is steadied.

According to (A3), a ground contact areas of the lumps of low melting point metal are increased by a receptacle. Consequently, adhering force of the lumps of low melting point metal to the fusible member is increased.

According to (A4), since the lumps of low melting point metal having are provided on the fusible member by spouting or dropping the melting metal drops, the fixing by caulking is no longer necessary. As a result, the cost-down is accomplished and no inconveniences as deformation occur. Further, the lumps of low melting point metal can be easily managed in mass only by controlling the amount of spouting or dropping the melting metal drops, so that the fusion-breaking time is consequently settled.

According to (A5), because of providing the lumps of low melting point metal, any especial process is not required to the fusible member. As a result, the cost-down is accomplished and the shape of the fusible member is steadied.

According to (A6), the ground contact areas of the lumps of low melting point metal are increased by the receptacle. Consequently, the adhering force of the lump of low melting point metal to the fusible member is increased.

(B1) In the fuse of the invention, a fusion-breaking portion of the fusible member is formed by spouting or dropping melting metal drops having electric conductivity, said fusion-breaking portion being fused and broken when an overload electrical current flows.

(B2) In the fuse of the invention, shapes of the pair of terminal connection portions have the same configuration.

(B3) A method of producing a fuse of the invention for solving the above mentioned problems is characterized by comprising steps of a first step of punching a metal sheet having electric conductivity for obtaining a pair of elements having parts to be formed with terminal connection portions to be electrically connected to an electric circuit, and a second step of forming a fusible member for electrically connecting the pair of elements each other, wherein the second step includes a step of forming a fusion-breaking portion of the fusible member by spouting or dropping melting metal drops having electric conductivity, said fusion-breaking portion being fused and broken when an overload electrical current flows.

(B4) In the method of producing the fuse of the invention, the shapes of the parts to be formed with the terminal connection portions are formed in the same configuration by the pair of elements each other.

According to (B1), the fusion-breaking portion of the fusible member is formed by spouting or dropping melting metal drops having electric conductivity. Accordingly, by adjusting the spout or drop of the melting metal drops so as to change the width of the fusion-breaking portion, it is possible to form the fuse element in response to the sorts of setting the fusion-breaking electric current even in one metal mold.

According to (B2), since the shapes of the pair of terminal connection portions have the same configuration, it is possible to reduce in size and simplify the shape of the metal mold.

According to (B3), the pair of elements are formed by punching the metal sheet in the first step. In the second step, the fusible member is formed for electrically connecting the pair of elements each other, and the fusion-breaking portion of the fusible member is formed by spouting or dropping the melting metal drops having electric conductivity. The fusion-breaking portion is changed in the width by adjusting the spout or drop of the melting metal drops. It is accordingly possible to form the fuse element of the fuse in response to the kinds of setting the fusion-breaking electric current in one metal mold.

According to (B4), the shapes of the parts to be formed with the terminal connection portions are formed in the same configuration by the pair of elements each other, the elements are made common, and consequently, the shape of the metal mold can be made small for simplification.

BRIEF DESCRIPTION OF THE DRAWINGS

FIGS. 1A and 1B are outside perspective views showing one embodiment of the fuse according to the invention, in which FIG. 1A is an exterior perspective view of the fuse, and FIG. 1B is an exterior perspective view of the fuse element;

FIGS. 3A and 3B are explanatory views of the second step, in which FIG. 3A is a perspective view before forming the fusion-breaking portion, and FIG. 3B is a cross sectional view after forming the fusion-breaking portion;

FIGS. 4A to 4C are developed views of the fuse elements, in which FIG. 4A is a plan view of the developed fuse element where the fusion-breaking electric current is set at, e.g., 30 A (ampere), FIG. 4B is the plan view of the developed fuse element where the fusion-breaking electric current is set at 40 A, and FIG. 4C is the plan view of the developed fuse element where the fusion-breaking electric current is set at 50 A;

FIGS. 7A and 7B are views showing another example of the fuse according to the first embodiment of the invention, in which FIG. 7A is an outside perspective view of the fuse, and FIG. 7B is a plan view of the fuse element;

FIGS. 11A and 11B are views of the second example of the fusible member, in which FIG. 11A is the explanatory view before forming the lumps of low melting point metal, and FIG. 11B is the explanatory view after forming the lumps of low melting point metal;

FIGS. 12A and 12B are views of the third example of the fusible member, in which FIG. 12A is the explanatory view before forming the lumps of low melting point metal, and FIG. 12B is the explanatory view after forming the lumps of low melting point metal;

FIGS. 13A and 13B are views of the fourth example of the fusible member, in which FIG. 13A is the explanatory view before forming the lumps of low melting point metal, and FIG. 13B is the explanatory view after forming the lumps of low melting point metal;

FIGS. 14A and 14B are views showing the conventional example, in which FIG. 14A is an outside perspective view of the fuse, and FIG. 14B is an outside perspective view of the fuse;

FIGS. 15A through 15C are developed views of the fuse elements of the related art, in which FIG. 15A is a plan view of the developed fuse element where the fusion-breaking electric current is set at, e.g., 30 A (ampere), FIG. 15B is the plan view of the developed fuse element where the fusion-breaking electric current is set at 40 A, and FIG. 15C is the plan view of the developed fuse element where the fusion-breaking electric current is set at 50 A;

DETAILED DESCRIPTION OF THE PREFERRED EMBODIMENTS (First Embodiment)

Explanation will be made to embodiments of the invention by use of attached drawings.

Figure 1A:
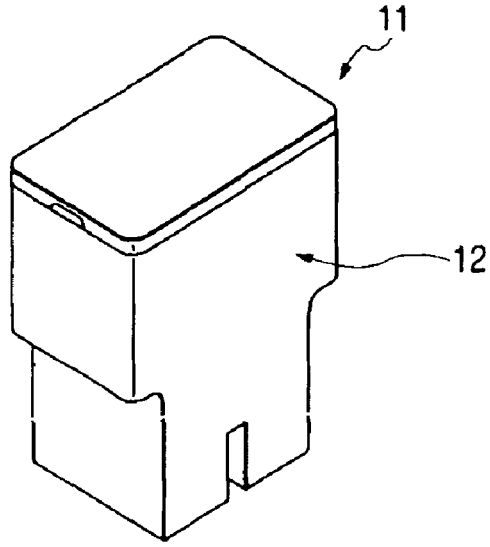
Figure 1B:
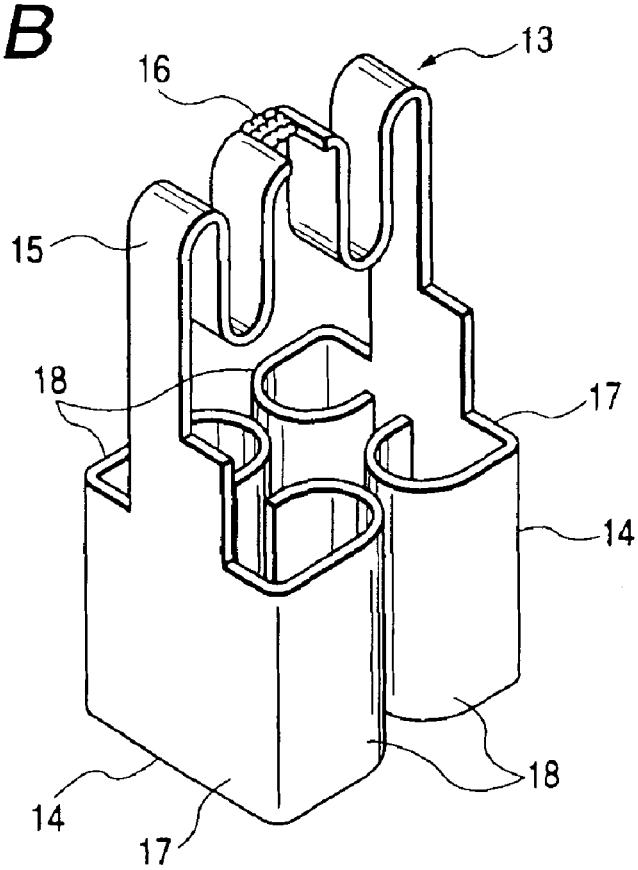
Figure 2:
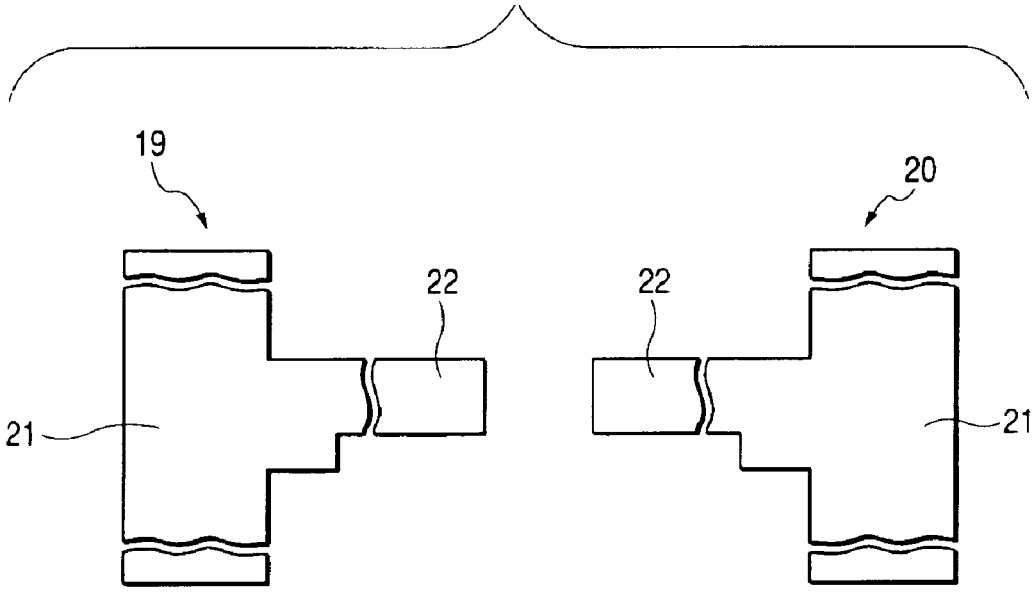
FIG. 2 is plan view of the first and second elements forming the fuse element (a view explaining the first step)
Figure 3A:
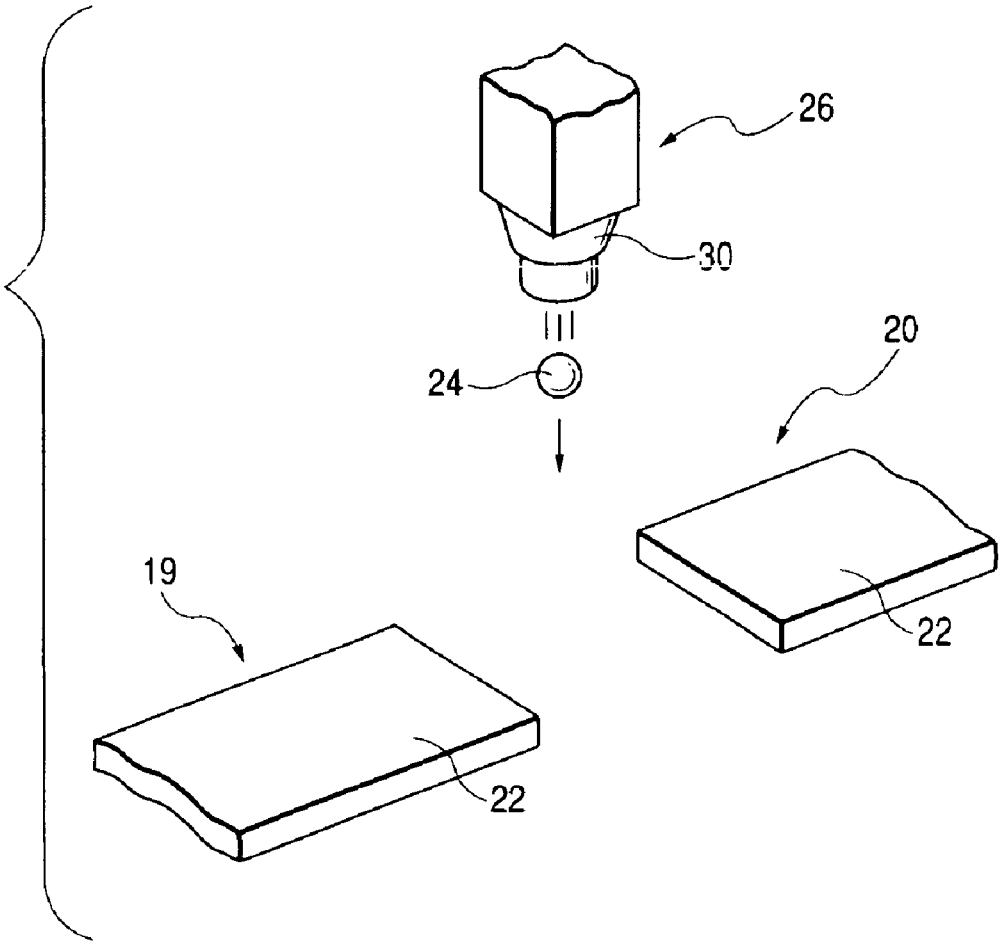
Figure 3B:
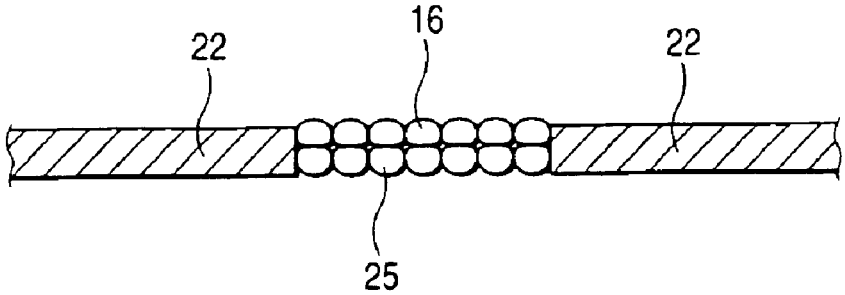
Figure 4A:
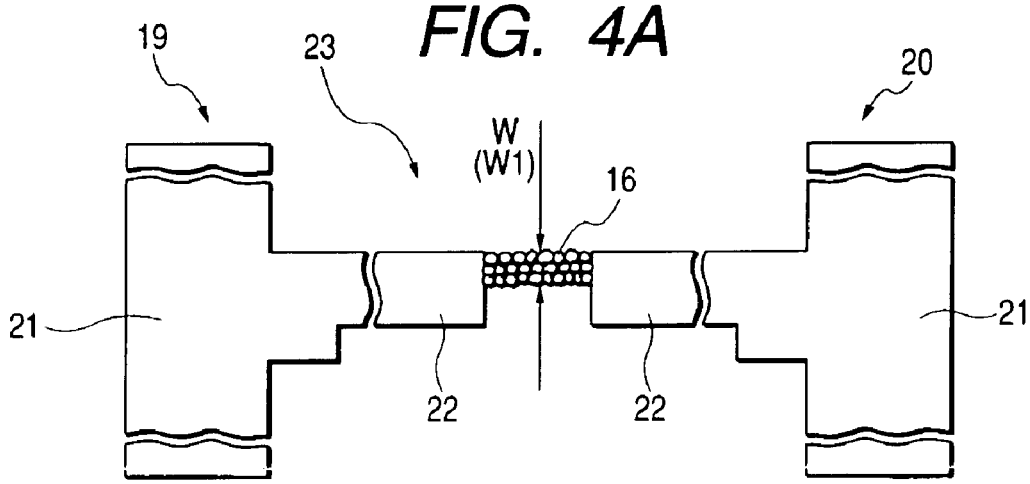
Figure 4B:
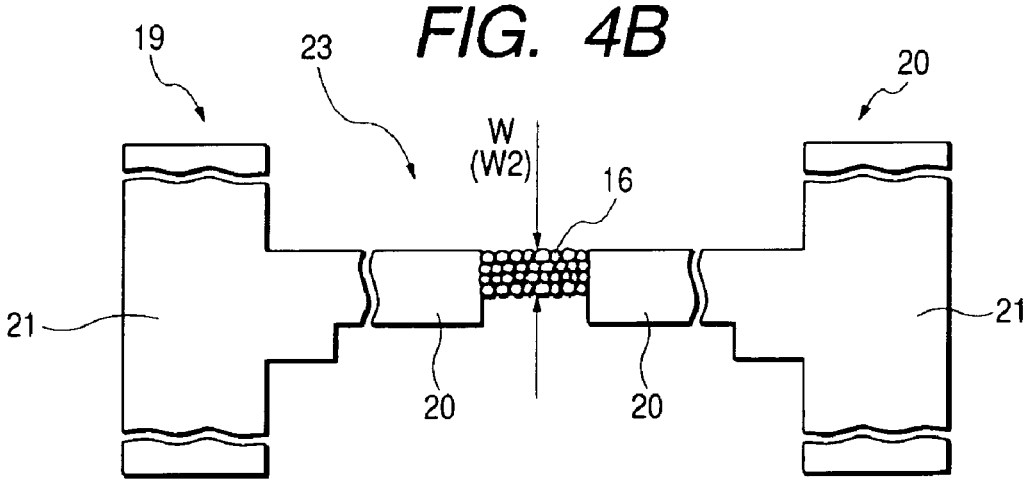
Figure 4C:
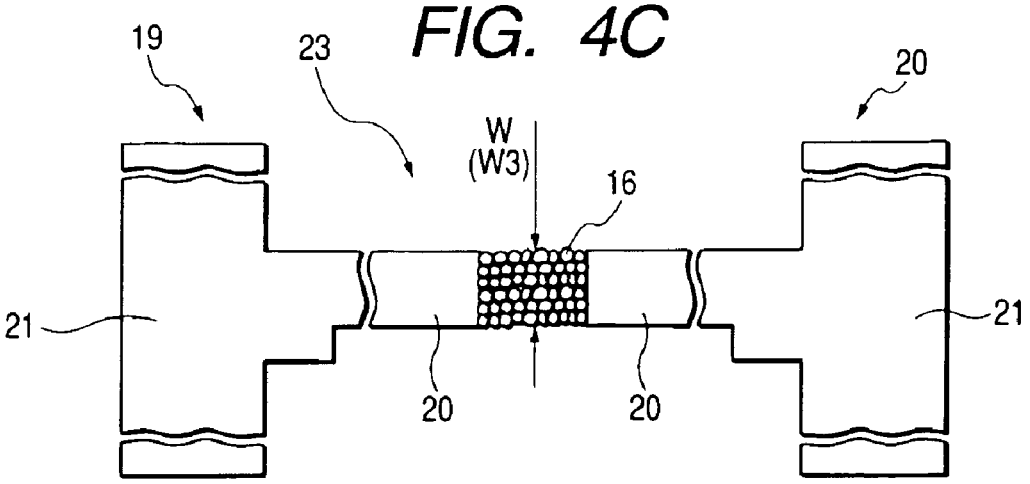
Figure 5:
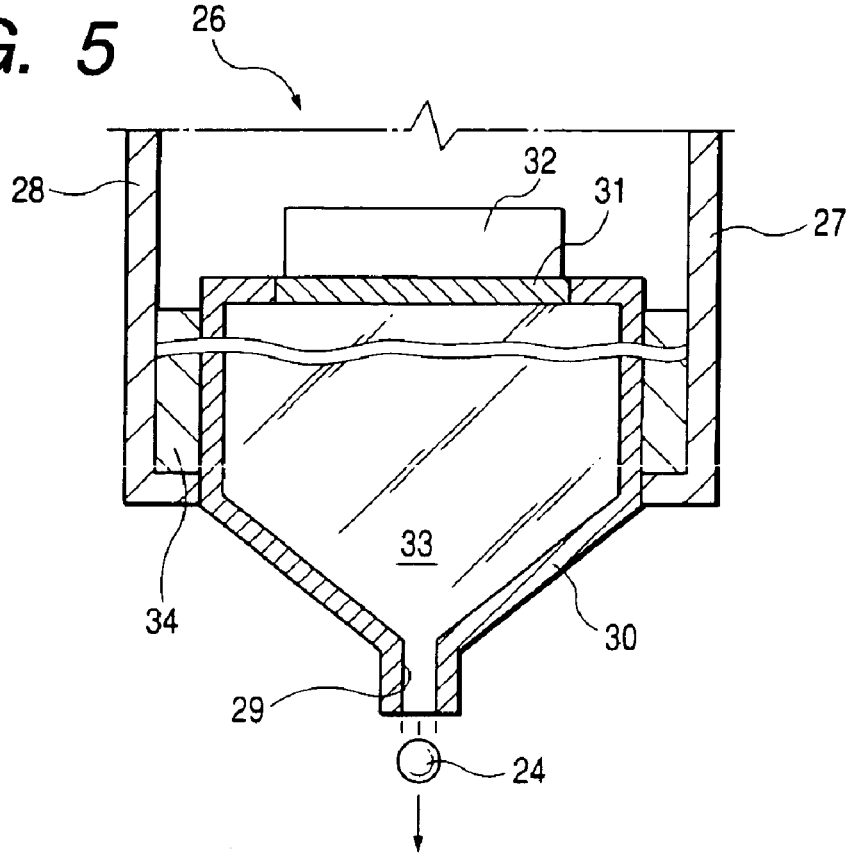
FIG. 5 is a cross sectional view of a melting metal drops-forming apparatus.

FIGS. 1A and 1B are outside perspective views showing the first embodiment of the fuse according to the invention. FIG. 2 is an explanatory view of the first step for the fuse production method. FIGS. 3A and 3B are explanatory views of the second step. FIGS. 4A through 4C are developed views of the fuse element. FIG. 5 is a cross sectional view of a melting metal drops-forming apparatus.

In FIGS. 1A and 1B, a fusible link 11 as one example of the fuse of the invention is composed of a known synthetic resin-made case 12 and an electrically conductive metal-made fuse element 13 carried within the case 12. The fuse element 13 has a pair of terminal connection portions 14, 14 and a fusible member 15 for electrically connecting the terminal connection portions 14, 14 each other, and at a central part of the fusible member 15, a fusion-breaking portion 16 is formed for being fused and broken when an overload electrical current flows. In the invention, at least the fusion-breaking portion 16 is formed by spouting or dropping the melting metal drops having the electric conductivity. Further, by adjusting the spout or drop of the melting metal drops, the width of the fusion-breaking portion 16 can be changed.

The pair of terminal connection portions 14, 14 are formed as female terminals which have respectively a pair of elastically holding arms continued to bases 17 and sides thereof. Between the bases 17 and free ends of the elastically holding arms 18, 18, opposite terminal connection portions are inserted (connected to an electric current via the opposite terminal connection portions). In this embodiment, the terminal connection portions are formed to be the same configuration. The fusible member 15 is shaped in band so that a whole continues along the central fusion-breaking portion 16. The central portion of the fusible member 15 is bent in U-shape.

The melting metal drops forming the fusion-breaking portion 16 are formed by spouting the fused metal from a nozzle by use of, e.g., a piezoelectric element or a gas, by sending by a gas a liquid drop fused by discharging a wire, or by jetting metal powders from the nozzle and fusing by the laser. In this embodiment, the melting metal drops are formed by the melting metal drops-jetting apparatus (later mentioned) having the nozzle.

Further reference will be made to a method of producing the fusible link (fuse) 11 on the basis of the respective structures. The production of the fusible link 11 passes the following steps.

In the first step, the thin metal sheet (flat metal sheet of a predetermined thickness) having the conductivity is punched to form the first element 19 and the second element 20 as seen in FIG. 2 (the first element 19 and the second element 20 correspond to the pair of elements set forth in the inventive aspects). The first and second elements 19, 20 are members for composing the fuse element 13 and are formed to have parts 21 for forming the terminal connection portions 14 and parts 22 for forming the fusible member 15. Further, the first and second elements 19, 20 are formed in the same configuration (the parts 21 forming the terminal connection portions 14 may be different. For reducing in size and simplifying the metal mold, it is desirable to form the first and second elements 19, 20 in the same configuration, that is, to make common therebetween).

In the second step, between parts for forming the respective melting bodies 15 of the first and second elements 19, 20, as seen in FIGS. 3A through and 4C, an electric connection is made by the fusion-breaking portion 16, thereby enabling to form the developed fuse element 23. Reference numeral 24 designates the melting metal drop formed by melting the electrically conductive metal. Through a cluster 25 of the melting metal drops 24 adhered between the parts 22, 22, the first element 19 and the second element 20 are electrically connected (the developed fuse elements 23 of FIGS. 4A through 4C are formed). The fusion-breaking portion 16 is so formed as to differ the width W. For example, FIG. 4A shows an example of the fusion-breaking electric current of 30 A (ampere), FIG. 4B is an example of 40 A, and FIG. 4C is an example of 50 A. The widths W of the fusion-breaking portion 16 is determined to be W1<W2<W3.

In the third step, the developed fuse element 23 is performed with a bending step to form the fuse element 13 as shown in FIGS. 1A and 1B. In the fourth step, the fuse element 13 is supported within the case 12, and the fusible link 11 under an accomplished condition is produced. The fusion-breaking portion 16 may be formed after the above mentioned bending step to the developed fuse element 23.

The structure of the melting metal drops-spouting apparatus will be explained, referring to FIG. 5. The melting metal drops-spouting apparatus 26 is structured with a melting metal drops-forming part 27, a fused material supplying source (not shown), and a moving instrument (not shown) of moving the melting metal drops-forming part 27 to a desired place, said fused material supplying source fusing electrically conductive metals and supplying them to the part 33 of forming melting metal drops.

The melting metal drops-forming part 27 comprises a case 28, a nozzle 30 having a hole 29 and projecting from the lower end of the case 28, a diaphragm 31 disposed at, e.g., an opposite side of the hole 29, a piezoelectric element 32 vibrating the diaphragm 31, and a heater 34 for heating a fused metal 33 supported in the nozzle 30 or keeping the temperature. When the fused metal 33 passes through the hole 29, it is spouted in forms of melting metal drops 24 on and off (the melting metal drops 31 is formed each time when the diaphragm 31 vibrates).

Incidentally, as other vibrating the diaphragm 31 than the piezoelectric element 32, there is a way of applying pressure by such as a gas. The amount, time interval and diameter of the melting metal drops 24 spouted on and off by the diaphragm 31 vibrating are appropriately determined. On the other hand, other than the structure of using the diaphragm 31 is to use a cylinder.

As have explained above referring to FIGS. 1A through 5, if the melting metal drops 24 are adjusted in the spouting or dropping for changing the width W of the fusion-breaking portion 16, it is possible to form the fuse element 13 in response to sorts of determining the fusion-breaking electric current even in one metal mold, accordingly to offer the fusible link 11 (fuse) excellent in lowering costs, and to exhibit similar effects in other two examples.

Figure 6:
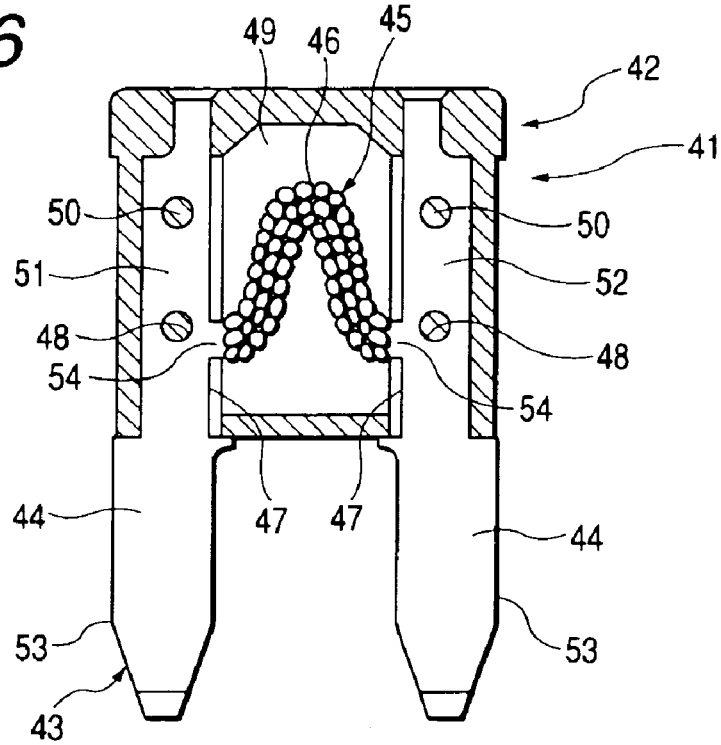
FIG. 6 is a cross sectional view showing another example of the first embodiment of the fuse according to the invention.

FIG. 6 is a cross sectional view showing another example of the fuse according to the embodiment. In the same, a fuse 41 as another example of the invention is composed of a known synthetic resin made-housing 42 and a fuse element 43 of a conductive metal partially carried in the housing 42. The fuse element 43 has a pair of terminal connection portions 44, 44 and a fusible member 45 for electrically connecting the terminal connection portions 44, 44 each other. The fusible member 45 is formed with the fusion-breaking portion 46 by spouting or dropping the melting metal drops 24 (see FIGS. 3A and 3B), which is fused and broken when an over current flows.

The pair of terminal connection portions 44, 44 are formed as male terminals of plate shape. The terminal connection portions 44, 44 are formed to be the same configuration. The terminal connection portions 44, 44 are formed with inner circumferences 47, 47 for the fusible member 45 and two attaching holes 48, 48 secured to the housing 42.

The fusible member 45 is bent in almost reverse U-shape, a whole body is the fusion-breaking portion 46 in this example, and is arranged in a space 49 (the fusion-breaking portion 46 splashes into this space) defined in the housing 42. Reference numeral 50 designates positioning pins of terminals formed in the housing 42. The terminal positioning pin 50 is inserted in the attaching hole 48.

Further reference will be made to a method of producing the fuse 41 through the following respective steps.

In the first step, the thin metal sheet (flat metal sheet of a predetermined thickness) having the conductivity is punched to form the first element 51 and the second element 52 (the first element 51 and the second element 52 correspond to the pair of elements set forth in the inventive aspects). The first and second elements 51, 52 are members for composing the fuse element 43 and are formed to have parts 53 for forming the terminal connection portions 44 and parts 54 for forming the fusible member 45. Further, the first and second elements 51, 52 are formed in the same configuration.

In the second step, between parts 54, 54 for forming the respective melting bodies 45 of the first and second elements 51, 52, an electric connection is made by the fusion-breaking portion 46, thereby enabling to form the fuse element 43. Through a cluster 25 (see FIGS. 3A and 3B) of the melting metal drops 24 (see FIGS. 3A and 3B) adhered between the parts 54, 54, the first element 51 and the second element 52 are electrically connected. Subsequently, in the third step, and a fuse element 43 is partially carried in the housing 42, and the fuse 41 under an accomplished condition is produced.

Figure 7A:
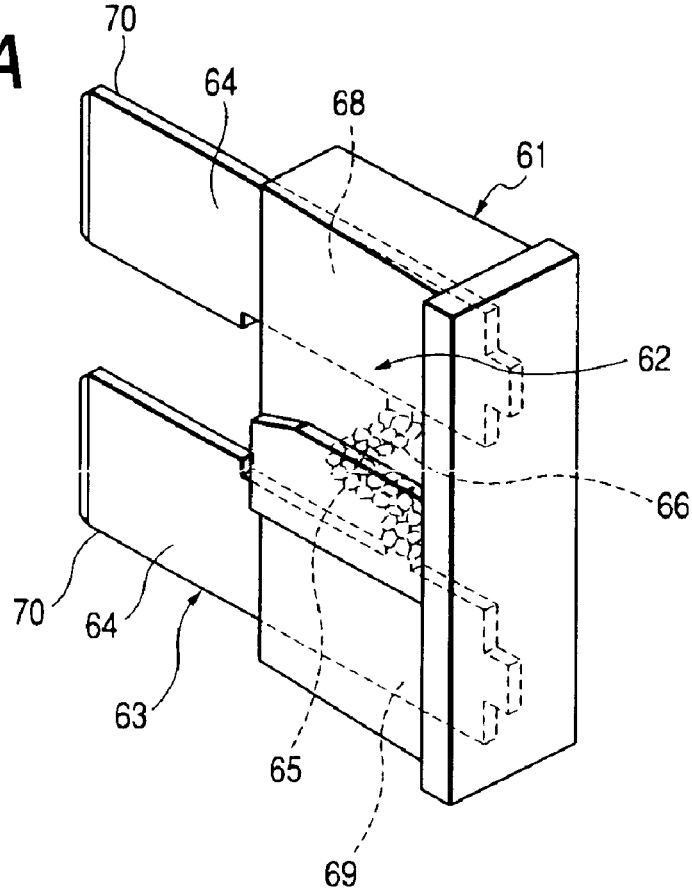
Figure 7B:
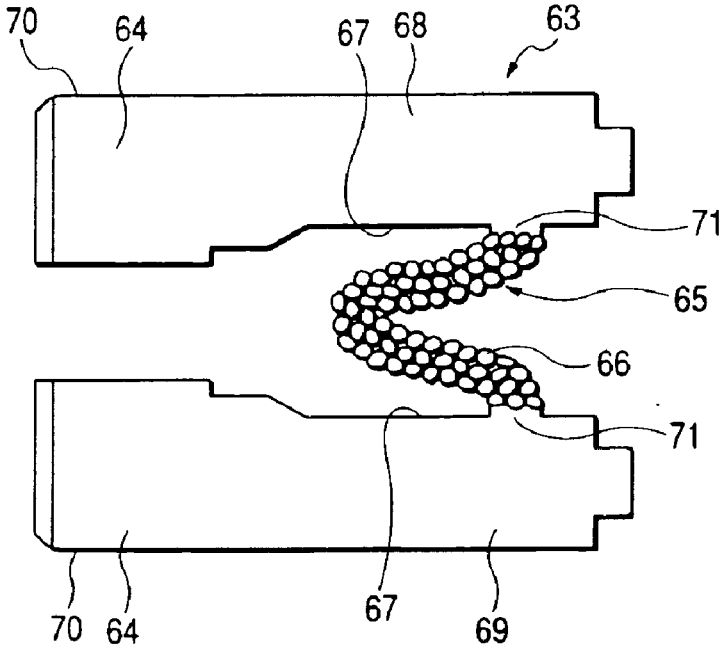

FIGS. 7A and 7B are views showing another example of the fuse according to the first embodiment of the invention.

In FIGS. 7A and 7B, a fuse 61 as an example of the invention is composed of a known synthetic resin made-housing 62 and a fuse element 63 of a conductive metal partially carried in the housing 62. The fuse element 63 has a pair of terminal connection portions 64, 64 and a fusible member 65 for electrically connecting the terminal connection portions 64, 64 each other. The fusible member 65 is formed with the fusion-breaking portion 66 by spouting or dropping the melting metal drops 64 (see FIGS. 3A and 3B), which is fused and broken when an over current flows.

The pair of terminal connection portions 64, 64 are formed as male terminals of plate shape. The terminal connection portions 64, 64 are formed to be the same configuration. The terminal connection portions 64, 64 are formed with inner circumferences 47, 47 for the fusible member 65. The fusible member 65 is bent in almost reverse U-shape when the lengthwise directions of the pair of terminal connection portions 64, 64 are met vertically. The fusible member 65 is the fusion-breaking portion 66 in this embodiment.

Further reference will be made to a method of producing the fuse 41 through the following respective steps.

In the first step, the thin metal sheet (flat metal sheet of a predetermined thickness) having the conductivity is punched to form the first element 68 and the second element 69 (the first element 68 and the second element 69 correspond to the pair of elements set forth in the inventive aspects). The first and second elements 68, 69 are members for composing the fuse element 63 and are formed to have parts 70 for forming the terminal connection portions 64 and parts 71 for forming the fusible member 65. Further, the first and second elements 68, 69 are formed in the same configuration.

In the second step, between parts 71, 71 for forming the respective melting bodies 65 of the first and second elements 68, 69, an electric connection is made by the fusion-breaking portion 66, thereby enabling to form the fuse element 63. Through the cluster 25 (see FIGS. 3A and 3B) of the melting metal drops 24 (see FIGS. 3A and 3B) adhered between the parts 71, 71, the first element 68 and the second element 69 are electrically connected. Subsequently, in the third step, and a fuse element 63 is partially carried in the housing 62, and the fuse 61 under an accomplished condition is produced.

(Second Embodiment)

Explanation will be made to the second embodiment of the invention by use of attached drawings.

Figure 8:
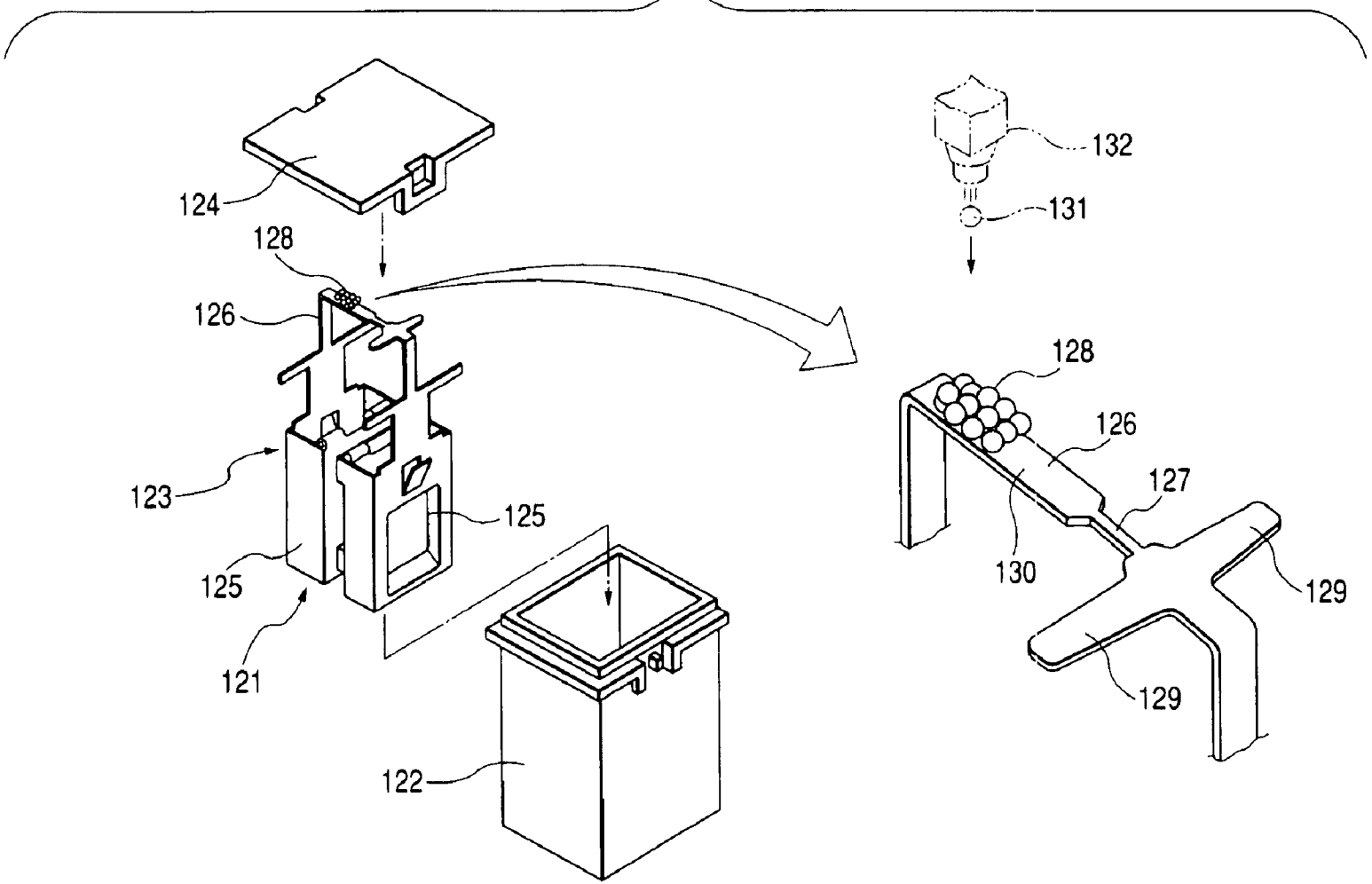
FIG. 8 is an exploded view showing the fuse of the second embodiment of the invention (including enlarged elementary parts)
Figure 9:
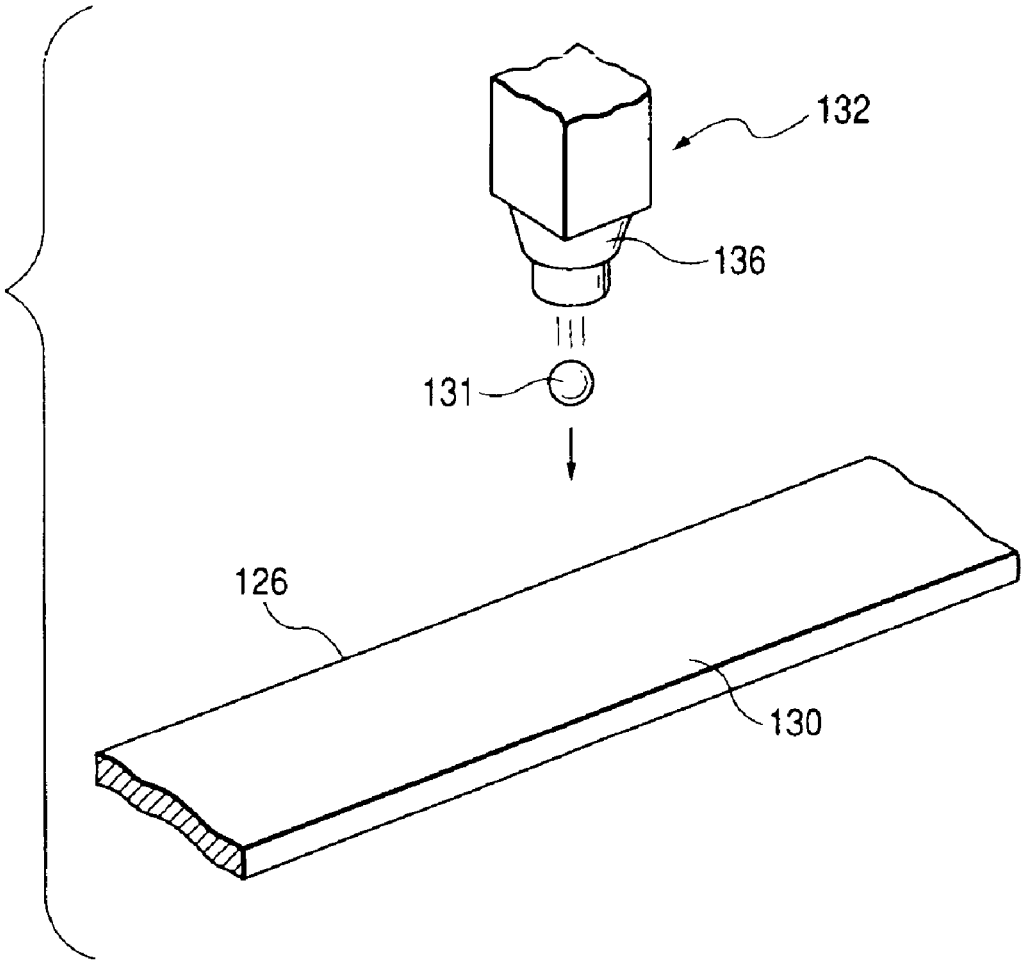
FIG. 9 is an explanatory view of the fuse production method.
Figure 10B:
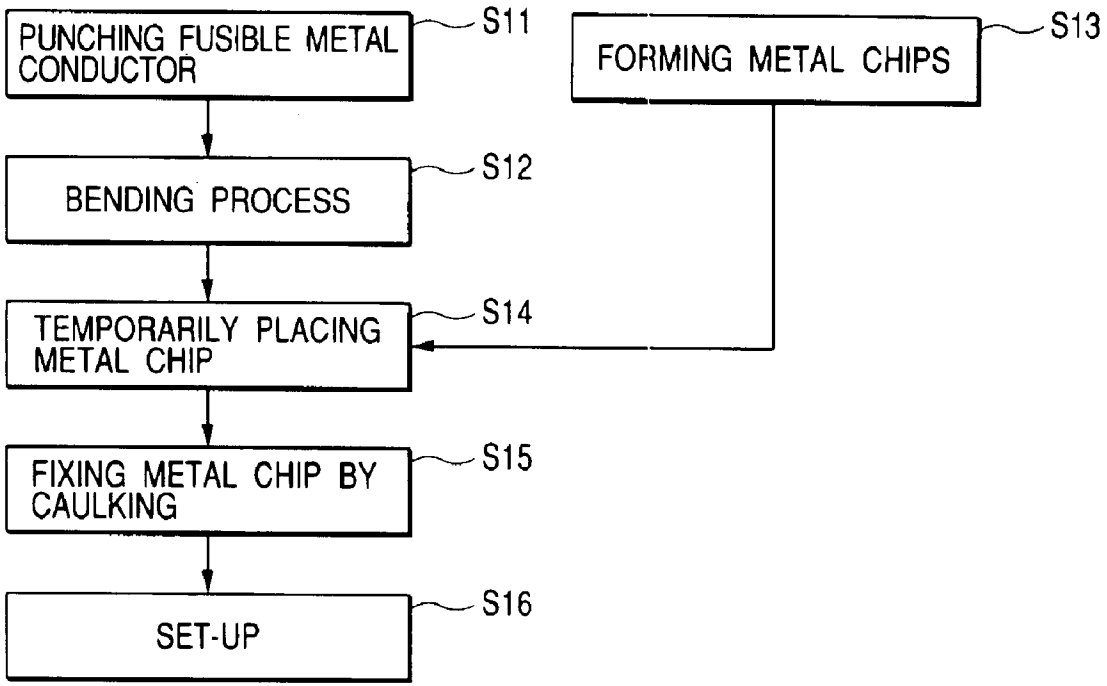
FIG. 10B is the flow chart of the steps according to the conventional step for comparison.
Figure 10A:
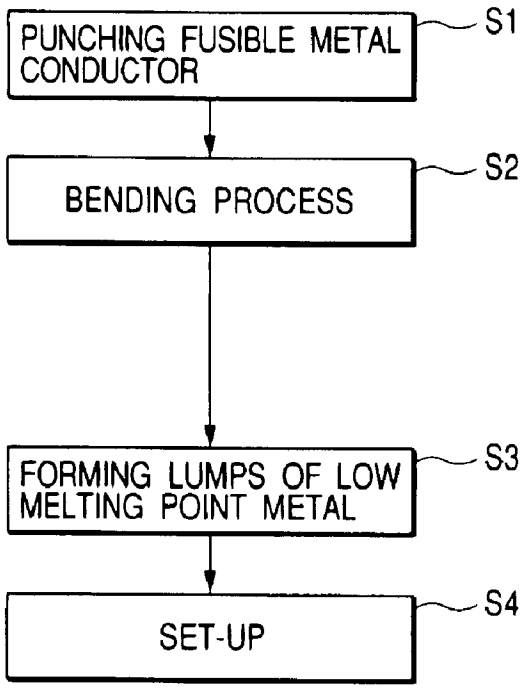
FIG. 10A is the flow chart of the steps according to the invention.

FIG. 8 is exploded views showing a fuse of the second embodiment of the invention. FIG. 9 is an explanatory view of a fuse production method, FIGS. 10A and 10B are flow charts of the fuse production method.

In FIG. 8, a fusible link (fuse) 121 of the invention comprises a known synthetic resin-made case 122, a fuse element 123 composed of a fusible metal conductor to be supported in the case 122, and a known transparent synthetic resin-made cover 124 to be fitted in a releasing part of the case 122. The fuse element 123 has a pair of terminal connection portions 125, 125 to be electrically connected to an electric circuit via opposite terminal connection portions and a fusible member (or main body of the fusible member) 126 electrically connecting the terminal connection portions 125, 125 each other. At a middle part of the fusible member 126, a fusion-breaking portion 127 is formed for fusing and breaking when an overload electrical current flows, and at one side of the fusion-breaking portion 127, the lumps 128 of low melting point metal, which form a cluster, are provided for adjusting the fusion-breaking characteristic of the fusible member 126, while at the other side a pair of radiating plate 129, 129 are formed.

In the invention, the lumps 128 of low melting point metal are formed on the main body of the fusible portion 126 by spouting or dropping the melting metal drops of metal having a lower melting point than that of the fusible member 126 and having electric conductivity. The lumps 128 constitutes a cluster as collective entity. Further, by adjusting the amount of spouting or dropping the melting metal drops, the mass of the lumps 128 of low melting point metal can be varied.

As for material of the above mentioned fusible metal conductor, Cu alloy (Cu alloy containing slightly Fe and P to Cu: almost Cu having electric conductivity) may be listed. As for material of the melting metal drops of forming the lumps 128 of low melting point metal, Sn (or equivalents of Sn: Sn is 99.5 wt %, the balance is impurities), and Sn alloys of the following compositions, whose main component is Sn and which have lower melting points than that of the fusible metal conductor, may be listed. As for Sn alloys, there are alloys of: Cu: 0.5 to 3.5 wt % and all of the balance being Sn; or Cu: 0.5 to 3.5 wt %, Sb: 1.0 to 6.0 wt % and all of the balance being Sn.

The melting metal drops forming the lumps 128 of low melting point metal are formed by spouting the fused metal from a nozzle by use of, e.g., a piezoelectric element or a gas, by sending by a gas a liquid drop fused by discharging a wire, or by jetting metal powders from the nozzle and fusing by the laser. In this embodiment, the melting metal drops are formed by the aforementioned jetting apparatus of the melting metal drops having the nozzle (blowing of a fixed amount is easy). Although the jetting apparatus of the melting metal drops is similar to the aforementioned embodiment, the metal served to be jetted in this embodiment should have a lower melting point that that of the melting metal drops in the aforementioned embodiment.

Further reference will be made to a method of producing the fusible link (fuse) 121 (see FIGS. 8 to 10A). The production of the fusible link passes a punching step S1 of the fusible metal conductor, a bending step S2, a forming step S3 of the lumps of low melting point metal, and a set-up step S4.

At first, in the punching step S1 of the fusible metal conductor, the fusible metal conductor (a flat, metal plate of a predetermined thickness) is punched so as to form parts of the terminal connection portions 125, 125, and a developing fuse element having a part forming the fusible member 126. Next, in the bending step S2, the developing fuse element is performed with the bending step so as to form the fuse element of a state prior to having the lumps of low melting point metal 128. Successively, in the forming step S3 of the lumps of low melting point metal, the fusible member 126 of the fuse element performed with the bending step receives the lumps 128 of low melting point metal on the flat part 130 thereof and accomplishes the fuse element 123. Herein, reference numeral 131 designates the melting metal drops, and the lumps 128 of low melting point metal are formed with agglomerate of the melting metal drops 131. At the last, in the set-up step S4, the fuse element 123 is supported in a case 122, the fuse element 123 being provided with the lumps 128 of low melting point metal on the flat part 130 of the fusible member 126, and the cover 124 is mounted on the releasing part of the case 122, so that the fusible link 121 is accomplished.

As have explained above referring to FIGS. 8 to 10B, since the lumps 128 of low melting point metal are provided for adjusting the fusion-breaking characteristic on the fusible member 126 by spouting or dropping the melting metal drops 131, the fixing by caulking metal chips as conventionally can be no longer necessary (the caulking step in the production method). Accordingly, inconveniences as deformation by the caulking can be avoided, and the cost-down is accomplished by not requiring the caulking.

As to the cost-down, the following will be also referred to. As shown in FIG. 10B, in the conventional step, the fusible link (fuse) has been produced through the six steps of a punching step S11 of the fusible metal conductor, a bending step S12, a forming step S13 of metal chips, a temporarily placing step S14 (onto the fusible member) of the metal chips, a fixing step S15 of the metal chips by caulking, and a set-up step S16. But in the invention, as shown in FIG. 10A, the fusible link is produced by passing only the four steps of the punching step S1 of the fusible metal conductor, the bending step S2, the forming step S3 of the lumps of low melting point metal, and the set-up step S4. Accordingly, the invention may curtail the production steps than the related art, enabling to cost down.

On the other hand, the lumps 128 of low melting point metal may be managed as to the mass only by adjusting the amount of spouting or dropping the melting metal drops 131, so that the fusion-breaking time can be made stable and the quality of the fuse can be improved. Further, any especial process is not required to the fusible member 126 for providing the lumps 128 of low melting point metal, and also in this point, the cost-down can be realized, and the forming of the fusible member can be made stable.

Figure 11A:
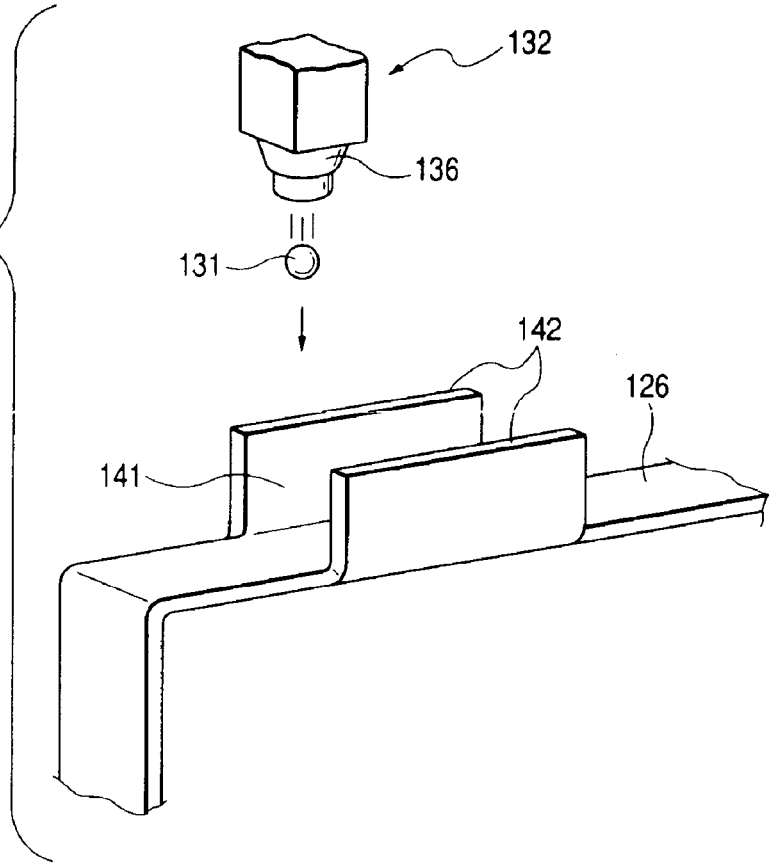
Figure 11B:
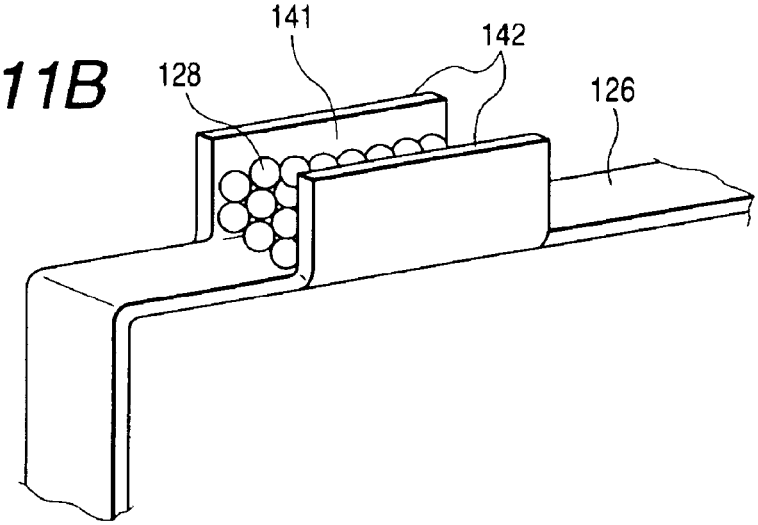

Next, other examples of the fusible member will be explained, referring to FIGS. 11A to 13B. FIGS. 11A and 11B show a second example of the fusible member, FIGS. 12A and 12B show a third example thereof, and FIGS. 13A and 13B show fourth example of the same.

In FIGS. 11A and 11B, the fusible member 126 is formed with a receptacle 141 which supports the lumps 128 of low melting point metal. The receptacle 141 is formed to have a pair of walls 142, 142 standing at sides of the fusible member 126 as illustrated.

Figure 12A:
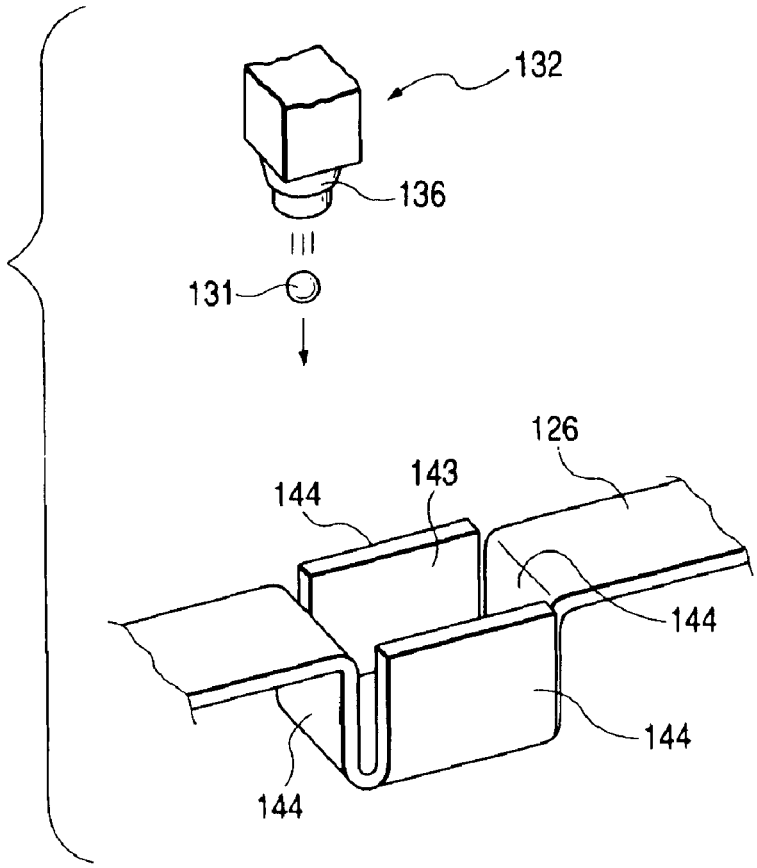
Figure 12B:
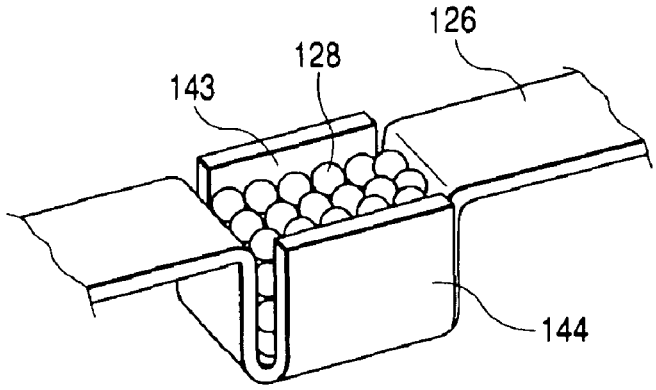

In FIGS. 12A and 12B, the fusible member 126 is formed with a receptacle 143 which supports the lumps 128 of low melting point metal. The receptacle 143 is formed by bending the fusible member 126 in concave to have four walls 144.

Figure 13A:
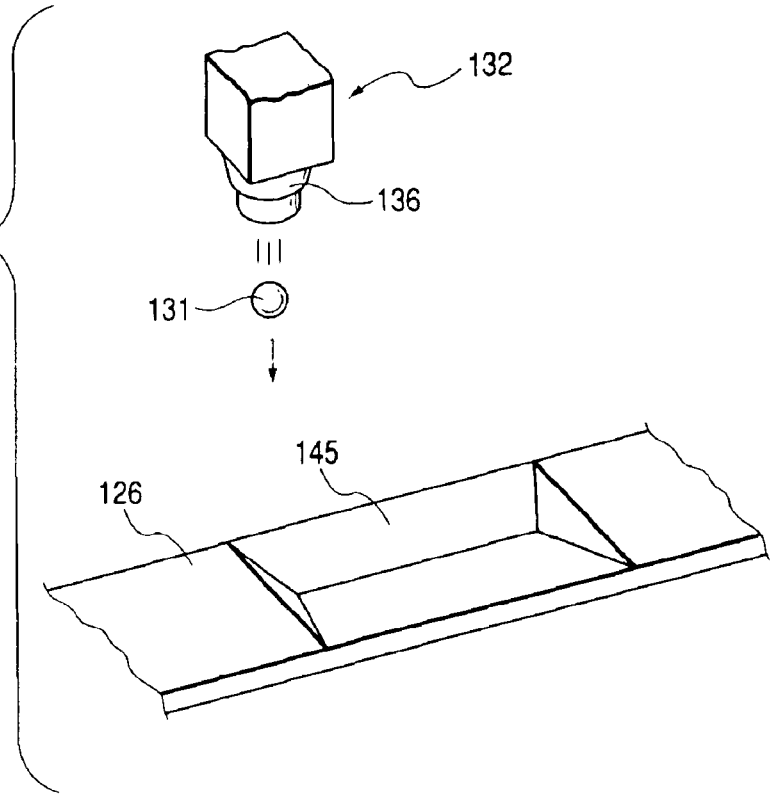
Figure 13B:
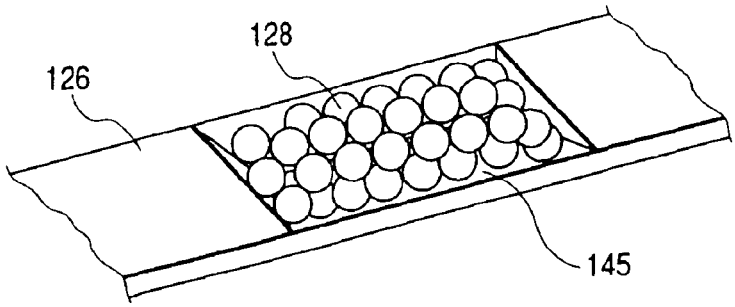
Figure 14A:
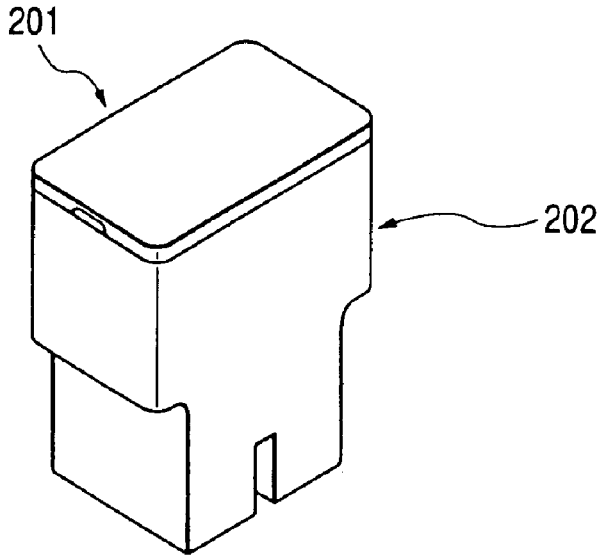
FIG. 14A PRIOR ART
Figure 14B:
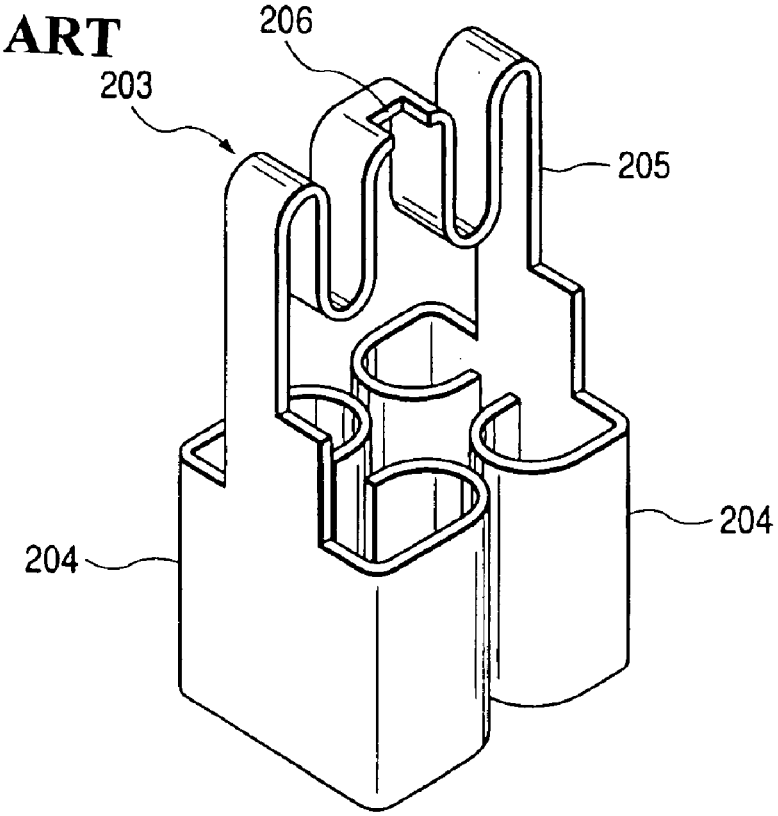
FIG. 14B PRIOR ART
Figure 15A:
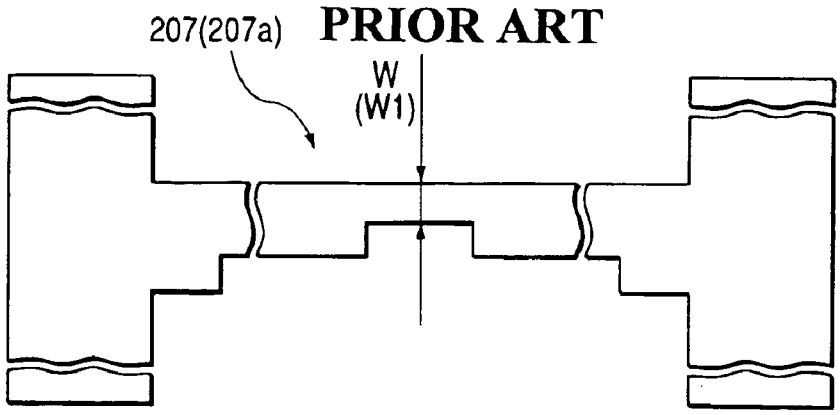
FIG. 15A PRIOR ART
Figure 15B:
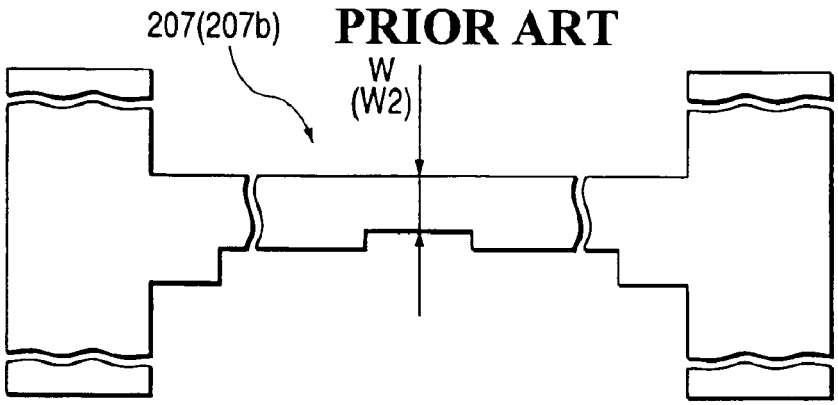
FIG. 15B PRIOR ART
Figure 15C:
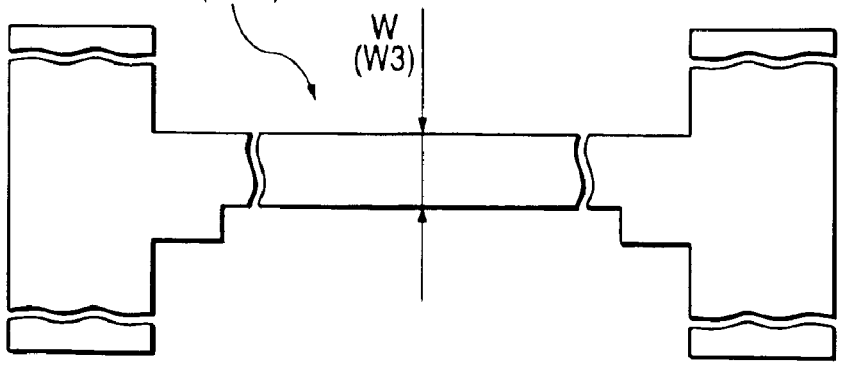
FIG. 15C PRIOR ART
Figure 16:
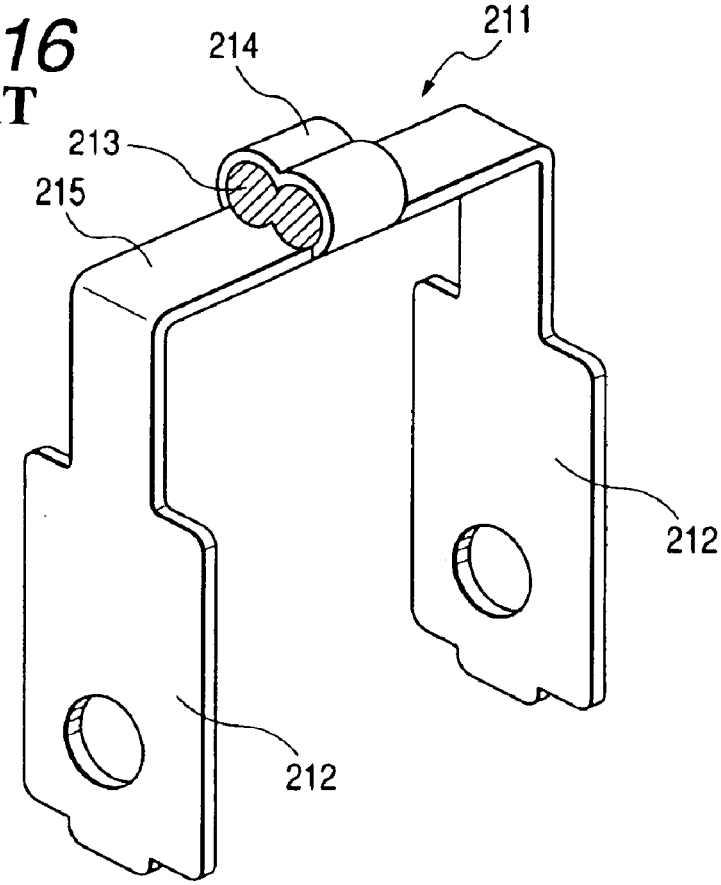
FIG. 16 PRIOR ART
FIG. 16 is an exterior perspective view of the fuse element of the related art.
Figure 17:
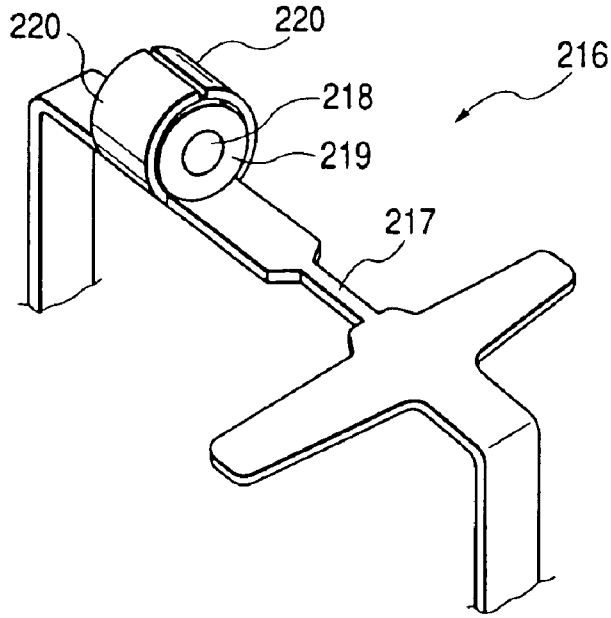
FIG. 17 PRIOR ART
FIG. 17 is a perspective view of the fuse element of the related art.

In FIGS. 13A and 13B, the fusible member 126 is formed with a receptacle 145 which supports the lumps 128 of low melting point metal. The receptacle 145 is formed by drawing the fusible member 126 in concave.

The above three examples may increase the ground contact areas of the lumps 128 of low melting point metal and heighten adhering force of the lumps 128 of low melting point metal to the fusible member 126. By the way, since the receptacles 141, 143, 145 can be formed in the bending step S2, the effect in the cost can be maintained.

Of course, the invention may be modified in a scope of not changing the subject matter of the invention.

As having explained above, according to the invention, the fuse enables to stabilize the fusion-breaking time and realize the cost-down, and prevent inconvenience as deformation.

According to the invention, such effects may be exhibited requiring no especial process to the fusible member because of providing the lumps of low melting point metal and realize the more cost-down. Requiring no especial process, a further effect may be exhibited enabling to stabilize shapes of the fusible member.

According to the invention, such effects maybe exhibited enabling to increase the ground contact areas of the lumps of low melting point metal by the receptacle and heighten the adhering force of the lumps of low melting point metal to the fusible member.

According to the invention, such effects maybe exhibited offering the fuse production method enabling to stabilize the fusion-breaking time and realize the cost-down, and prevent inconvenience as deformation.

According to the invention, such effects maybe exhibited requiring no especial process to the fusible member because of providing the lumps of low melting point metal and realize the more cost-down. Requiring no especial process, a further effect may be exhibited enabling to stabilize shapes of the fusible member.

According to the invention, such effects maybe exhibited enabling to increase the ground contact areas of the lumps of low melting point metal by the receptacle and heighten the adhering force of the lumps of low melting point metal to the fusible member.

Further, according to the invention, by changing the spout or drop of the melting metal drops so as to change the width of the fusion-breaking portion, it is possible to form the fuse element in response to the sorts of setting the fusion-breaking electric current even in one metal mold. Such effects may be accordingly exhibited offering the fuse excellent in the cost-down.

According to the invention, since the shapes of the pair of terminal connection portions have the same configuration, it is possible to reduce in size and simplify the shape of the metal mold, so that the cost-down may be more effective.

According to the invention, by changing the spout or drop of the melting metal drops so as to change the width of the fusion-breaking portion, it is possible to form the fuse element in response to the sorts of setting the fusion-breaking electric current even in one metal mold. Such effects may be accordingly exhibited offering the fuse production method excellent in the cost-down.

According to the invention, the shapes of the parts to be formed with the terminal connection portions are formed in the same configuration by the pair of elements each other, the elements are made common, and consequently, the shape of the metal mold can be made small for simplification, so that the cost-down may be more effective.

What is claimed is:

1. A fuse comprising:

a fuse element provided with a pair of terminal connection portions to be connected to an electric circuit, and a fusible member through which the pair of terminal connection portions are connected to each other, and which is fused and broken when an overload electrical current flows therein, wherein at least a part of the fusible member is provided with a cluster of melting metal drops in which adjacent drops contact each other such that the cluster of metal drops extend from one of the terminal contact portions to the other of the terminal contact portions.

2. A fuse according to claim 1, wherein said cluster of melting metal drops are lumps of low melting point metal formed on a main body of the fusible member, the low melting point metal having a lower melting point than that of the main body of the fusible member, and the lumps of low melting metal adjust a fusion-breaking characteristic of the fusible member.

3. A fuse according to claim 2, wherein the lumps of low melting point metal are provided on a plane part of the fusible member.

4. A fuse according to claim 2, wherein the lumps of low melting point metal are supported in a receptacle provided on the fusible member.

5. A fuse according to claim 2, the lumps of low melting point metal are constituted by Sn or Sn alloy whose main component is Sn.

6. A fuse according to claim 1, wherein the cluster of the melting metal drops having electric conductivity is fused and broken when an overload electrical current flows therein, thereby breaking a connection between said terminal connection portions.

7. A fuse according to claim 6, wherein shapes of the pair of terminal connection portions have the same configuration.

8. The fuse of claim 1, wherein said cluster of melting metal drops are dropped or spouted.

9. A fuse according to claim 8, wherein said cluster of melting metal chops are lumps of low melting point metal formed on a main body of the fusible member, the low melting point metal having a lower melting point than that of the main body of the fusible member, and the lumps of low melting metal adjust a fusion-breaking characteristic of the fusible member.

10. A fuse according to claim 9, wherein the lumps of low melting point metal are provided on a plane part of the fusible member.

11. A fuse according to claim 9, wherein the lumps of low melting point metal are supported in a receptacle provided on the fusible member.

12. A fuse according to claim 9, the lumps of low melting point metal are constituted by Sn or Sn alloy whose main component is Sn.

13. A fuse according to claim 8, wherein the cluster of the melting metal drops having electric conductivity is fused and broken when an overload electrical current flows therein, thereby breaking a connection between said terminal connection portions.

14. A fuse according to claim 13, wherein shapes of the pair of terminal connection portions have the same configuration.

15. A method of producing a fuse, wherein the fuse comprises a pair of terminal contact portions which is to be connected to a electric circuit and a fusible member through which the pair of terminal contact portions are connected to each other and which is fused and broken when a overload current flows therein, the method comprising the step of:

forming at least one part of the fusible member by spouting or dropping melting metal drops to form a cluster of the melting metal drops in which adjacent metal drops contact each other such that said cluster of metal drops extend from one of the terminal contact portions to the other of the terminal contact portions.

16. A method of producing a fuse according to claim 15, wherein said cluster of the melting metal drops are lumps of low melting point metal formed on a main body of the fusible member for adjusting a fusion-breaking characteristic of the fusible member by spouting or dropping melting metal drops of a metal having a lower melting point than that of the fusible member.

17. A method of producing a fuse according to claim 16, wherein the fusible member has the lumps of low melting point metal are formed on a plane part the fusible member.

18. A method of producing a fuse according to claim 16, wherein the lumps of low melting point metal are formed in a receptacle formed in the fusible member.

19. A method of producing a fuse according to claim 15, further comprising steps of:

first step of punching a metal sheet having electric conductivity for obtaining a pair of parts constituting the terminal connection portions; and second step of forming the fusible member;

wherein the second step includes spouting or dropping said melting metal drops having electric conductivity, said melting metal drops being fused and broken when an overload electrical current flows, thereby breaking a connection between said terminal connection portions.

20. A method of producing a fuse according to claim 19, the pair of the parts punched in the first step are formed substantially in the same shape.

* * * * *